US006955166B2

(12) United States Patent
Rock

(10) Patent No.: US 6,955,166 B2
(45) Date of Patent: Oct. 18, 2005

(54) TARGET JUMPER

(75) Inventor: Byron James Rock, 72 N. 500 E. 121-1, Roosevelt, UT (US) 84066

(73) Assignee: Byron James Rock, Vernal, UT (US)

( * ) Notice: Subject to any disclaimer, the term of this patent is extended or adjusted under 35 U.S.C. 154(b) by 0 days.

(21) Appl. No.: 10/782,883

(22) Filed: Feb. 23, 2004

(65) Prior Publication Data

US 2005/0183707 A1 Aug. 25, 2005

(51) Int. Cl.[7] ..... F41B 3/03; F41J 9/18
(52) U.S. Cl. ..... 124/16; 124/36
(58) Field of Search ..... 124/7, 16, 17, 124/36

(56) References Cited

U.S. PATENT DOCUMENTS 3,731,932 A * 5/1973 Breslow et al. ..... 273/384
3,777,733 A * 12/1973 Mitchell ..... 124/7
3,841,294 A * 10/1974 McGill ..... 124/16
4,111,179 A * 9/1978 Hashimoto ..... 124/7
4,860,717 A * 8/1989 Powell et al. ..... 124/7
4,906,001 A * 3/1990 Vaughn ..... 473/438
6,129,076 A * 10/2000 Powell et al. ..... 124/7
6,343,597 B1 * 2/2002 Spikes ..... 124/7
6,546,923 B2 * 4/2003 Erickson ..... 124/16
6,644,292 B1 * 11/2003 Ganson ..... 124/7

* cited by examiner

*Primary Examiner*—John A. Ricci

(57) ABSTRACT

This is a device for launching targets into the air for target practice. The launcher includes a base, a release lever pivotally mounted to the base and having an impact target, and a throwing lever mounted to the base and having target holding cups. A spring is mounted within the base, and biases the throwing lever away from the base, through a pair of lifting arms. The release lever has a notch which mates with a tab on the throwing lever to hold the throwing lever cocked. Upon impact of a projectile on the impact target, the release lever will pivot away from the throwing lever, allowing the throwing lever to spring up, and launch targets received in the holding cups.

5 Claims, 5 Drawing Sheets

TARGET JUMPER

BACKGROUND OF INVENTION

This invention was initially made up to enhance recreational shooting or planning in the field. It saves on a useless slaughter of varmints in the field, the invention is compact, easy to assemble and use. I have kept this simple as possible with as many options as possible. This idea and first prototype was made in March of 2003.

BRIEF SUMMARY OF THE INVENTION

This invention relates in general to a mechanism for testing and honing shooting skills For the professional and recreational shooter.

The principal objection is to provide a new way for a shooter to engage a stationary primary target which releases a moving secondary target, or targets.

This device is portable and versatile in construction and usage.

BRIEF DESCRIPTION OF THE PARTS OF THE INVENTION

Figure 1:
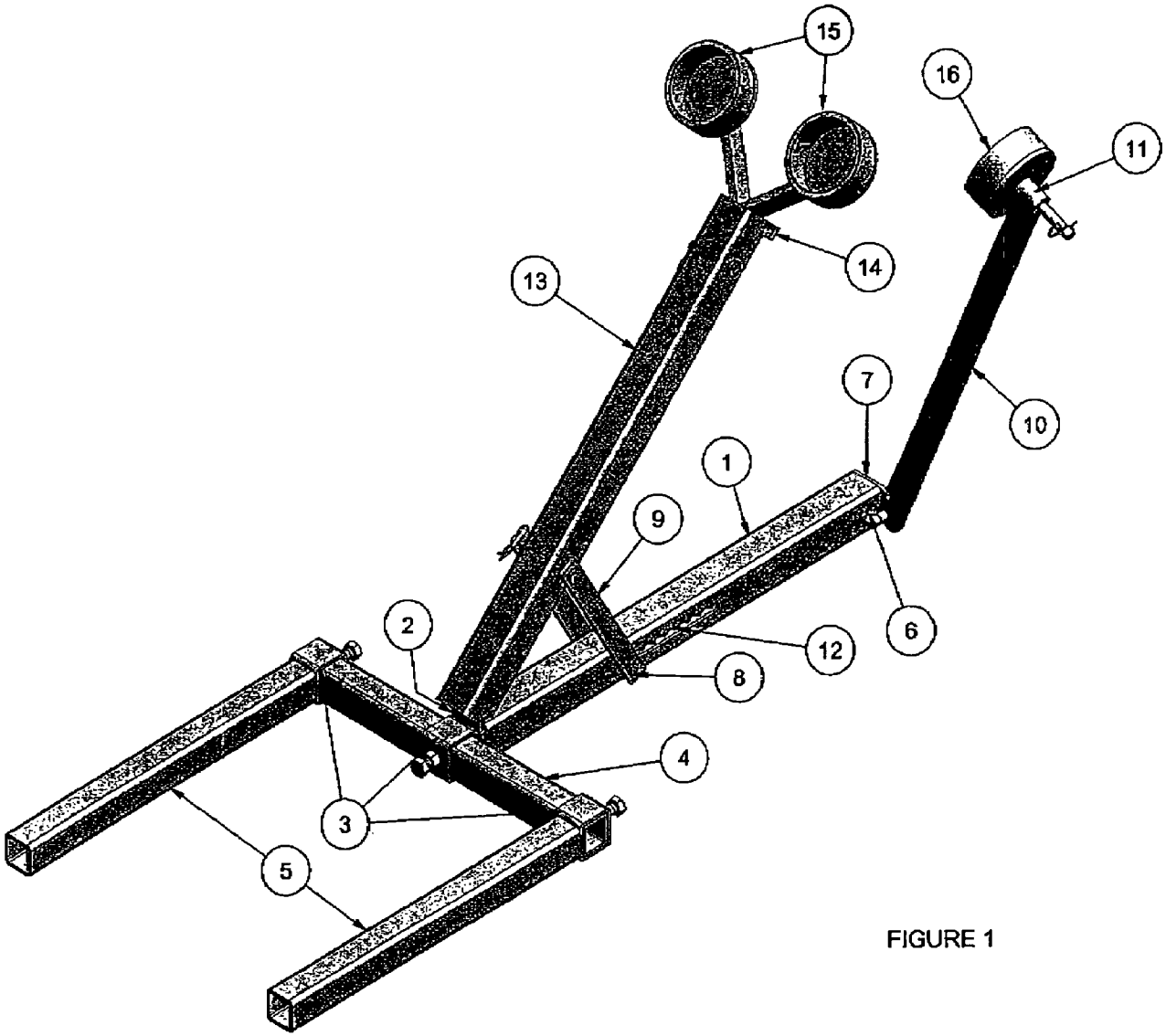
FIG. 1 is a front, right side perspective view of the target launcher in a shooting position.
Figure 2:
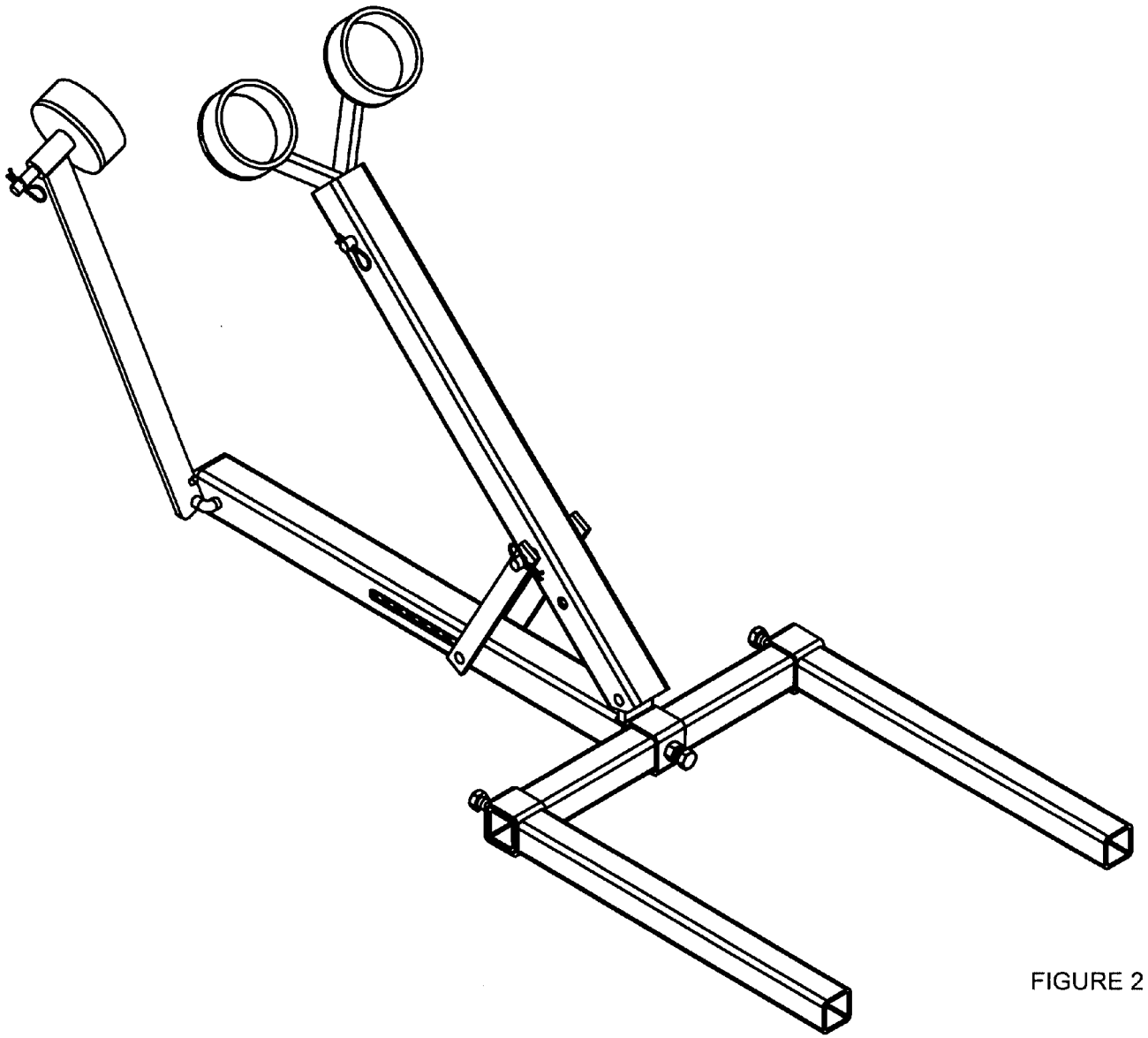
FIG. 2 is a front, left side perspective view of the target launcher in a shooting position.
Figure 3:
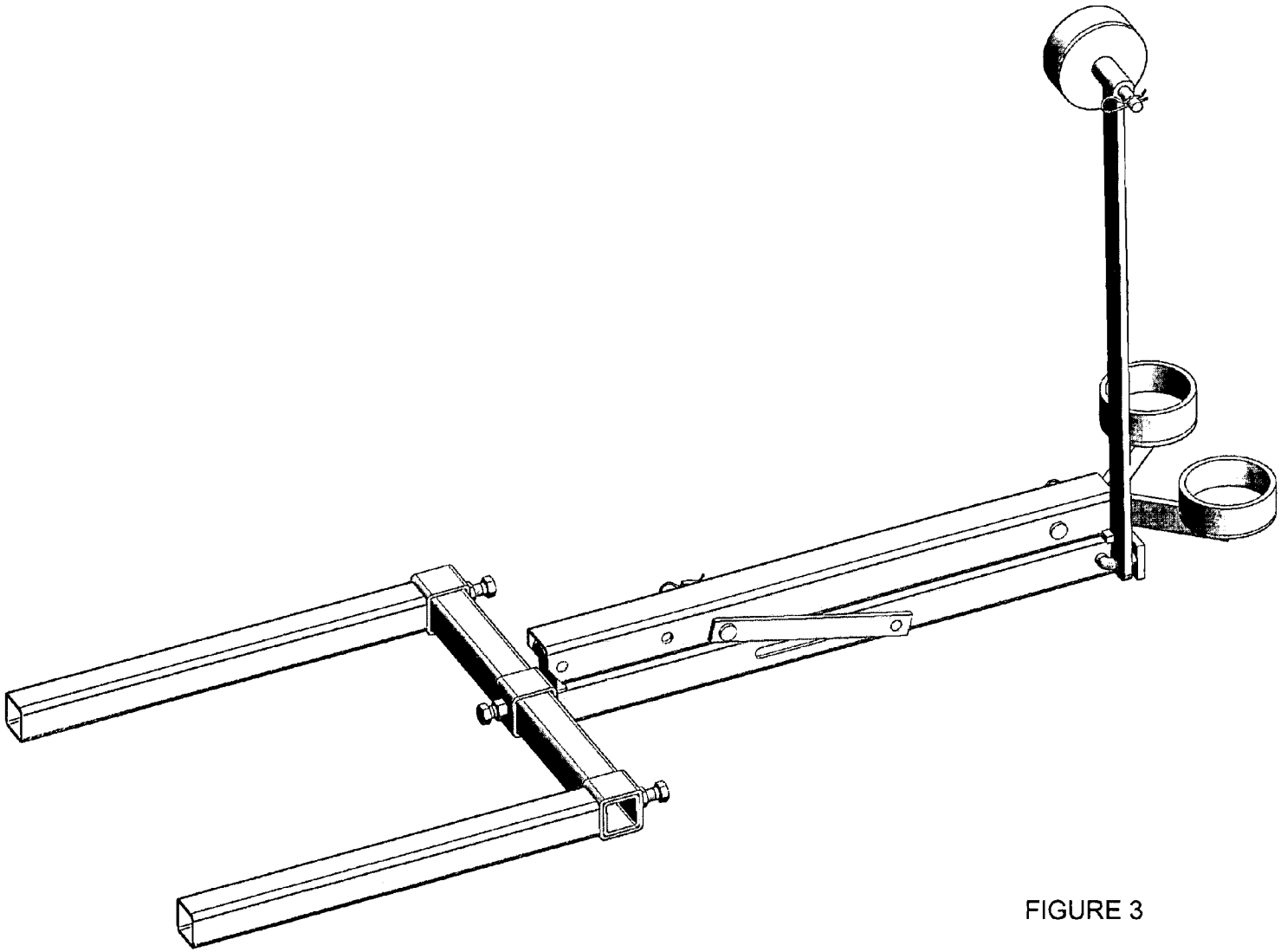
FIG. 3 is a front, right side perspective view of the target launcher in a cocked position.
Figure 4:
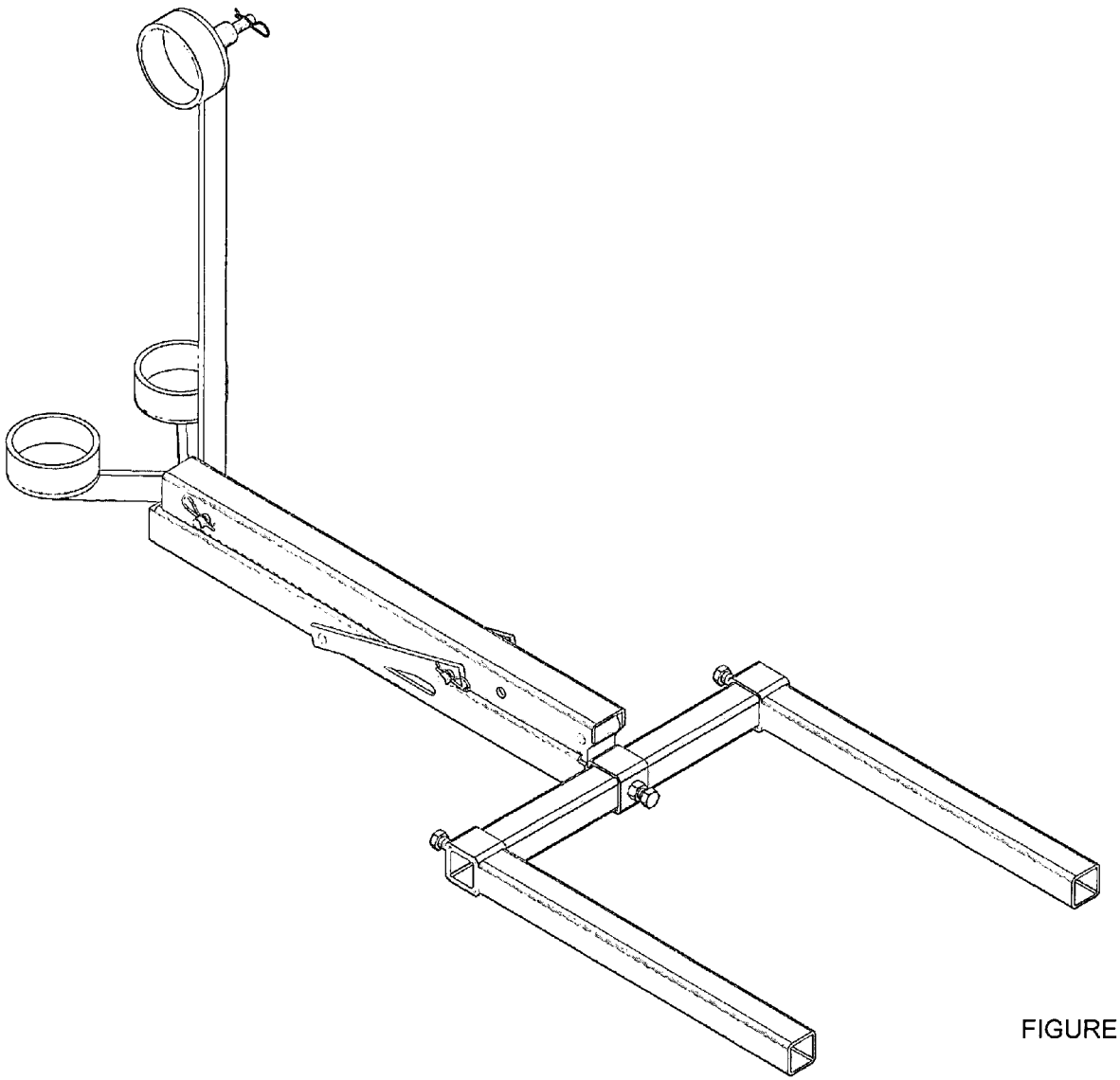
FIG. 4 is a front, left side perspective view of the target launcher in a cocked position.
Figure 5:
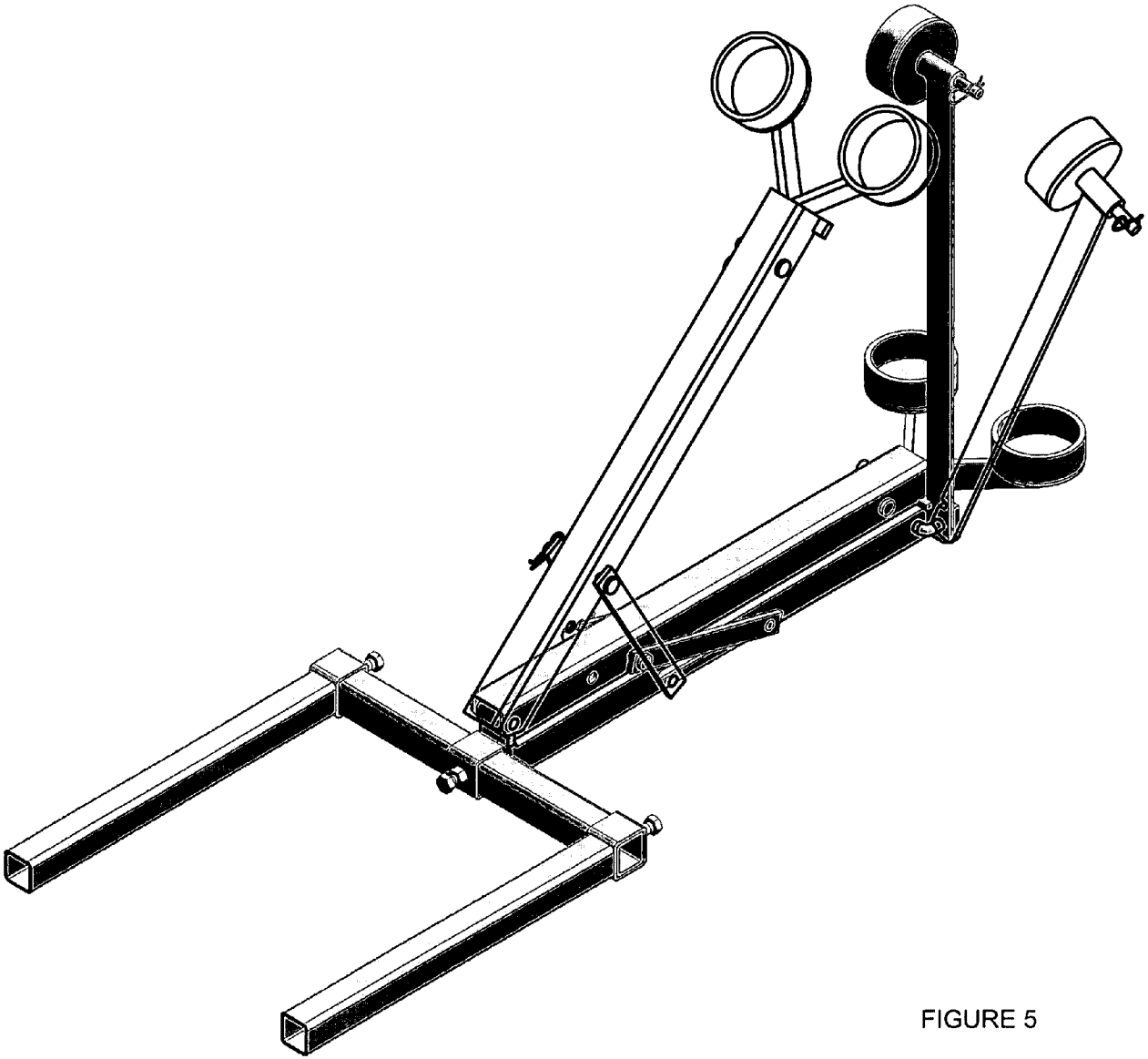
FIG. 5 is a front, right side perspective view of the target launcher showing the movement of parts as the launcher moves from a cocked position to a shooting position.

Refer to FIG. 1

BASE 1: The base houses the spring, anchor points for lifting arms and lever, and has the sliding slot milled in the side.

HINGE 2: The hinge is the anchor point for the throwing lever.

STABILIZER BAR SLEEVES 3: The stabilizer bar sleeves attach the stabilizer bar to the base and the extensions.

STABILIZER BAR 4: The stabilizer bar hold holds the extensions and keeps the thrower upright.

STABILIZER BAR EXTENSIONS 5: The stabilizer bar extensions keep the thrower from jumping over.

PIVOT PIN 6: The pivot pin or "L" bolt is the anchor point for the release lever.

END CAP 7: The end cap retains the spring in the base and is the attaching point for the pivot pin.

SLIDING LIFTING PIN 8: The sliding lifting pin connects the lifting arms together and pushes them upward.

LIFTING ARMS 9: The lifting arms push the throwing lever up.

RELEASE LEVER 10: The release lever locks the throwing lever to the base with the notch and tab.

IMPACT TARGET CUP MOUNTING SLEEVE 11: This holds the interchangeable primary target.

COMPRESSION SPRING 12: This 150-pound spring provides the energy for the mechanism to work.

THROWING LEVER 13: This holds the throwing cup or cups, and lifts to two different adjustments.

LOCKING LEVER TAB 14: This stores the energy until the lever is activated.

TARGET CUP HOLDER 15: This is interchangeable in size or in number of cups.

IMPACT TARGET CUP 16: This is interchangeable in size and in materials.

DETAILED DESCRIPTION OF THE INVENTION

The building process will involve cutting, drilling, milling, and welding to manufacture this item.

The materials list includes the following:

| Quantity | Size | Material |
|---|---|---|
| 2 | 1.5" × 1.5" × 19.5" | Square tubing .125" wall |
| 3 | 1.5" × 1.5" × 1.5" | Square tubing .125" wall |
| 3 | 1" × 1" × 14" | Square tubing .125" wall |
| 1 | 3" × 1" | Round tubing .125" wall |
| 1 | 3" × 1" | Round tubing .1875" wall |
| 2 | .75" × 1.5" | Round tubing .1875" wall |
| 1 | 1" × 18.5" × .250" | Flat strap |
| 2 | .75" × 7" × .1875" | Flat strap |
| 3 | 1.75" × 2.250" × .3125" | Flat strap |
| 1 | 1" × 7" × .250" | Flat strap |
| 1 | .375" × .5" × .250" | Flat strap |
| 4 | .375" × 2.5" | Solid Rod |
| 3 | .375" × 1" | Bolt with nut |
| 1 | .125" × 3" | Disc |
| 1 | .1875" × 3" | Disc |
| 2 | .375" × 3" | Clevis pin |
| 3 | 1" | Retainer Pin |
| 1 | 1" × 12" | 150 lb. Compression spring |

The base 1 is made from 1.5"×1.5"×19.5" square tubing. One end is notched across the width of one side. The notch is for the hinge to be welded in. The hinge 2 is made with 1.250"×0.750" round tube with a 0.1875" wall and 1.250"×0.250" flat strap. The round tube is welded along the top edge of the strap.

Once the hinge is welded in, the stabilizer can be welded on. The sleeve will have a 0.375" hole in front on center with a nut welded over it. A 0.375"×1" bolt can be screwed on. This will lock the stabilizer bar 4 on. The stabilizer bar extensions 5 are 1"×1"×14" square tubing with 0.125" wall. On one end a 1.5"×1.5"×1.5" square tubing is welded perpendicular to the 14" shaft. This is a sleeve 3 for the stabilizer bar extension to attach to the stabilizer bar. These two sleeves need a 0.375" hole with a nut welded over the hole. A 1" bolt can be screwed on each one.

The slot for the sliding pin is milled 0.375" wide, and 5" long centered on the base. The slot begins 4.750" from the hinge end. The opposite end of the hinge end is the locking lever pivot point.

The pivot pin 6 is a 0.375"×2.5" rod bent into a "L" shape, and welded to a 2.250"×1.250"×0.250" flat strap. The flat strap 7 needs a 0.375" hole drilled 0.3125" from the end on center for the pivot pin to be aligned and welded into position.

A 0.375"×2.5" rod 8 is installed into the milled slot of the base, and the lifting arms 9 are welded onto the rod ends. The lifting arms are 0.750"×7"×0.1875" flat straps with 0.375" holes drilled 0.50" from each end. The rod and arms are welded into a "U" shape.

The release lever 10 is 1"×18.5"×0.250" flat strap with a 0.375" hole drilled 0.50" from the end. The corners are rounded to allow the lever to fall freely on the "L" rod. A 0.250"×0.250" notch is cut 1" above the hole. On the other end of the lever a 0.750"×1.5" tube with a 0.1875" wall is welded along the top edge. This will be the impact target cup mounting point.

The 150 lb. compression spring 12 is installed through, the pivot point end, and the "L" rod and release lever and end cap strap are installed and welded on.

The throwing lever 13 is 1.5"×1.5"×19.5" square tubing with a 0.125" wall. A hole is drilled on one end for the hinge pin. This hole will be 0.375", and in a corner 0.5" from the end, and 0.5" from the bottom. Another 0.375" hole is drilled 3.750" from the hinge pin hole on center. From the hole (light tension setting), another 0.375" hole is drilled 1.5" center to center (heavy tension setting).

The locking lever end is opposite of the hinge end and it needs the locking lever tab 14 welded on. The locking lever is 0.375"×0.5"×0.250" flat strap. This is welded on the same side the locking lever is located on. The tab is flat with the bottom 0.250" from the end. From this end, 2" on center, a 0.375" hole is drilled. This is to hold the target holder cup in place.

The target holder cup 15 is 3"×1" round tubing with a 0.125" wall and a 0.125"×3" disc with a 1"×7"×0.250" flat strap. One end of the strap has a 1.250"×2.250"×0.3125" flat strap welded flat with a 0.375" hole drilled on center 1" from the end. The cup end of the strap has a 3" disc 0.135" thick welded perpendicular to the strap. This strap ends in the center of the disc. On top of the disc, the 3" round tube is welded.

The impact target cup 16 is made up of a 0.1875"×3" disc, and a 3" diameter, 1" long pipe with a 0.1875" wall, and a 0.375"×2.5" solid rod. The disc and pipe are welded together to form a cup, and the rod is welded perpendicular on the back on center. The rod has a 0.0625" hole, 0.250" from the end to receive a retainer pin. This pin locks the target cup to the release lever.

The throwing lever is capable of holding two target holder cups. This enables two targets in the air to to be shot into the air.

In the operation of the target shooter, the stabilizer bar with stabilizer extensions are mounted to the base by means of bolts.

The thrower cup is then installed onto the throwing lever using a 0.375"×2.5" clevis pin to lock it on.

The lifting arms need to be aligned on the light or heavy tension setting, and clevis pin installed with a retainer pin.

Then, while holding the locking, or release, lever 10, one would press down on the throwing lever 13, and pivot the lever 10 to engage its notch with lock tab 14 to lock the throwing lever in place. The locking lever and locking tab should be secure.

A target object is then placed on the throwing cup.

The Target Jumper is ready for use. A weapon or weapons may be used to fire projectiles toward impact target cup 16, to pivot release lever 10 away from throwing lever 13, to release targets in cups 15 into the air.

The impact target cup 16 can be replaced with a different size, or different materials to meet the needs of the shooter. For instance, an archery type disc with a pin on the back can be used to catch arrows and release the locking lever.

I claim:

1. A target launcher, comprising:

a hollow, tubular base having a first end and a second closed end;

a pair of opposing slots cut through the tubular base, intermediate the first and second ends, for accommodating a sliding lifting pin;

a compression spring within the tubular base, between the second closed end and the lifting pin, for biasing the lifting pin toward the first end;

a throwing lever pivotally attached to the base near its first end, the throwing lever having a first end and a second end, and at least one target holding cup mounted to the throwing lever near its second end;

a pair of lifting arms hingedly attached to opposite sides of the throwing lever, and extending to opposite ends of the lifting pin, such that movement of the lifting pin toward the first end of the base pivots the throwing lever away from the base;

a locking tab affixed to the throwing lever near its second end;

a release lever pivotally attached to the base near its second end, the release lever having a first end and a second end;

a notch cut into the release lever near its first end, the notch for engagement with the locking tab in a first pivotal position of the release lever, to hold the throwing lever in a cocked position;

an impact target cup mounted to the release lever near its second end;

whereby, impact of an object into the impact target cup will pivot the release lever to a second pivotal position, releasing the notch from the locking tab, and allowing the throwing lever to pivot away from the base, and launching at least one target received in the target holding cup.

2. The target launcher of claim 1, further including a stabilizer assembly, including a first stabilizer bar attached to the tubular base and extending perpendicular to the tubular base.

3. The target launcher of claim 2, further including two additional stabilizer bars attached to the first stabilizer bar and extending perpendicular to the first stabilizer bar.

4. The target launcher of claim 1, in which the throwing lever includes a transverse through bore which receives a pin, and the two lifting arms are hingedly attached to opposite ends of this pin.

5. The target launcher of claim 1, in which the throwing lever includes multiple transverse through bores at points along its length, and a pin is inserted through a selected one of the through bores, and the two lifting arms are hingedly attached to opposite ends of this pin, thus providing an adjustment of the throwing force.

* * * * *